US006891521B2

(12) United States Patent
Park et al.

(10) Patent No.: US 6,891,521 B2
(45) Date of Patent: May 10, 2005

(54) DRIVING METHOD FOR A LIQUID CRYSTAL DISPLAY DEVICE AND DRIVING CIRCUITS THEREOF

(75) Inventors: Joon-Ha Park, Taegu (KR); Min-Hwa Kim, Taegu (KR)

(73) Assignee: LG.Philips LCD Co., Ltd., Seoul (KR)

( * ) Notice: Subject to any disclaimer, the term of this patent is extended or adjusted under 35 U.S.C. 154(b) by 320 days.

(21) Appl. No.: 09/893,566

(22) Filed: Jun. 29, 2001

(65) Prior Publication Data

US 2002/0033787 A1 Mar. 21, 2002

(30) Foreign Application Priority Data

Sep. 18, 2000 (KR) ..... 2000-54676

(51) Int. Cl.[7] ..... G09G 3/36

(52) U.S. Cl. ..... 345/87; 345/204; 345/98; 345/100

(58) Field of Search ..... 349/87, 90, 92, 349/93, 94, 98, 100, 204–206; 359/54, 55, 57, 59; 345/87, 90, 92, 93, 94, 98, 100, 204, 205, 206

(56) References Cited

U.S. PATENT DOCUMENTS 4,955,697 A * 9/1990 Tsukada et al. ..... 350/332
5,285,301 A * 2/1994 Shirahashi et al. ..... 359/59
5,745,090 A * 4/1998 Kim et al. ..... 345/90
5,867,139 A * 2/1999 Tanaka et al. ..... 345/92
5,926,173 A * 7/1999 Moon ..... 345/211
5,940,055 A * 8/1999 Lee ..... 345/87
5,946,068 A * 8/1999 Lee et al. ..... 349/143
6,130,654 A * 10/2000 Hayashi et al. ..... 345/63
6,204,895 B1 * 3/2001 Nakamura et al. ..... 349/5

* cited by examiner

*Primary Examiner*—Regina Liang
*Assistant Examiner*—Jennifer T. Nguyen
(74) *Attorney, Agent, or Firm*—McKenna Long & Aldridge LLP

(57) ABSTRACT

A method of driving a liquid crystal display device, wherein the liquid crystal display device adopts a previous gate type including a gate line; a data line perpendicularly crossing with the gate line; a dummy gate line adjacent the gate line; a thin film transistor connected to the gate and data lines to serve as a switching element; a liquid crystal capacitor receiving signals from the thin film transistor; and a storage capacitor connected to the liquid crystal capacitor, the method including applying a dummy gate signal to the dummy gate line, wherein the dummy gate signal has substantially the same waveform as a gate signal applied to the gate line.

8 Claims, 6 Drawing Sheets

DRIVING METHOD FOR A LIQUID CRYSTAL DISPLAY DEVICE AND DRIVING CIRCUITS THEREOF

This application claims the benefit of Korean Patent Application No. 2000-54676 filed on Sep. 18, 2000, which is hereby incorporated by reference as if fully set forth herein.

BACKGROUND OF THE INVENTION

1. Field of the Invention

The present invention relates to a liquid crystal display (LCD) device, and more particularly, to a driving circuit and method for a liquid crystal display device.

2. Discussion of the Related Art

As information technologies rapidly develop, flat panel display devices develop with such pace. A liquid crystal display (LCD) device, which has been researched and developed in such rapid way, is an example of the flat panel display device.

A typical LCD device includes an upper substrate, a lower substrate, and an interposed liquid crystal therebetween. The upper and lower substrates respectively have electrodes opposing each other. When an electric field is applied between the electrodes of the upper and lower substrates, molecules of the liquid crystal are aligned according to the electric field. By controlling the above-mentioned electric field, the liquid crystal display device provides various transmittances for rays of light such that an image is displayed.

A driving method for driving the LCD device is classified into a passive matrix driving method and an active matrix driving method. The passive matrix driving method uses a voltage difference induced between a data line (a video line) and a gate line (a scanning line). Whereas, the active matrix driving method uses a switching element, usually a transistor. Presently, an active matrix LCD (AM LCD) device adopting the active matrix driving method is most focused on because of its high resolution and superiority in displaying video data.

A typical AM LCD device has a plurality of switching elements and pixel electrodes, which are arranged in the form of a matrix on the lower substrate. Therefore, the lower substrate of the AM LCD device is sometimes referred to as an array substrate. On the upper substrate of the AM LCD device, a common electrode made from a transparent conductive material is usually formed. In case of a color LCD device, a color filter is further formed between the upper substrate and the common electrode. The above-mentioned lower substrate and the upper substrate are attached to each other using a sealant. A liquid crystal is interposed between the upper and lower substrates.

The pixel electrode on the lower substrate and the common electrode on the upper substrate form a liquid crystal capacitor. A data signal and a common signal are respectively applied to the pixel electrode and the common electrode. Then, a voltage difference is induced therebetween such that the liquid crystal capacitor is electrically charged. At this point, electric discharges generally occur at the liquid crystal capacitor until a next data signal is applied. To prevent the above-mentioned discharges such that the voltage difference therebetween maintains its value, a storage capacitor is usually connected with the liquid crystal capacitor. The storage capacitor further serves to stabilize gray level displays and prevent flicker and residual images.

There are two possible configurations for the above-mentioned storage capacitor. A first configuration includes a capacitor electrode on the lower substrate connected to the common electrode on the upper substrate. In the second configuration, a portion of the gate line is used as an electrode of the storage capacitor. Specifically, a portion of an (n−1)th gate line is used as the electrode of the storage capacitor for an nth pixel. The first configuration is referred as a "storage-on-common" structure or an independent storage capacitor type. The second configuration is referred as a "storage-on-gate" structure or a previous gate type.

FIGS. 1 and 2 respectively show the above-mentioned first and second configurations for the storage capacitor. FIG. 1 is a circuit diagram illustrating an equivalent circuit for the independent storage capacitor type, and FIG. 2 is a circuit diagram illustrating an equivalent circuit for the previous gate type.

As shown in FIG. 1 for the independent storage capacitor type, a plurality of gate and data lines 11 and 12 are perpendicularly disposed crossing each other. A TFT 13, a liquid crystal capacitor 14, and a storage capacitor 15 are disposed in a pixel region "P" defined by the crossing gate and data lines 11 and 12. The storage capacitor 15 and liquid crystal capacitor 14 form a parallel circuit therebetween. The independent storage capacitor type has an advantage of a short signal delay.

As shown in FIG. 2 for the previous gate type, a plurality of gate and data lines 21 and 22 are also perpendicularly disposed crossing each other. A TFT 23 is disposed in a pixel region "P" defined by the crossing gate and data lines 21 and 22. The TFT 23 serves as a switching element. A liquid crystal capacitor 24 is further disposed in the pixel region "P" and is electrically connected with the TFT 23, and a storage capacitor 25 is disposed adjacent to the liquid crystal capacitor 24. Here, the storage capacitor 25 is not connected to a gate line $G_n$ that applies signals to the TFT 23 connected with the corresponding liquid crystal capacitor 23. The storage capacitor 25, however, is connected to a previous gate line $G_{n-1}$ that precedes the above-mentioned gate line $G_n$ which applies signals to the TFT 23 connected with the corresponding liquid crystal capacitor 23. Thus, the storage capacitor 25 is disposed between the previous gate line $G_{n-1}$ and the liquid crystal capacitor 24.

As previously mentioned, the above-described previous gate type uses a portion of the previous gate line as an electrode of the storage capacitor. The previous gate type has advantages of a high aperture ratio and a high production yield.

A typical LCD device adopting the previous gate type, however, needs an additional dummy gate line 26 arranged above a first gate line $G_1$, because there is no previous gate line preceding the first gate line $G_1$. Thus, the dummy gate line 26 is additionally formed above the first gate line $G_1$, and a portion thereof is used as an electrode of the storage capacitor 25 connected with the liquid crystal capacitor 24 in a first pixel region "P1".

For the typical LCD device adopting the previous gate type, pulse signals are sequentially applied to all the gate lines (reference 21 of FIG. 2), as shown in FIG. 3. Each of the signals has a high period, where the voltage thereof is highest, and a low period. Whenever each of the pulse signals is "high", a corresponding TFT 23 is "on". Whenever each of the pulse signals is "low", a corresponding TFT 23 is "off". Preferably, a positive voltage signal is applied for the high period, and a negative voltage signal is applied for the low period. Hereinafter, the pulse signal applied to the gate line 21 is referred to as a gate signal. Each of the above-mentioned gate signals preferably includes just one pulse during one frame. The pulse of each gate signal preferably has a different timing from those of the others, and the period of the pulse is the same as a horizontal line period "1H".

As previously mentioned, the dummy gate line 26 is additionally formed above the first gate line "$G_1$". When a first gate signal is applied to the first gate line $G_1$, the TFT "23" is "on" such that a data signal is applied to a pixel electrode (not shown) via the data line 22. To charge the storage capacitor 25 connected to the dummy gate line 26, a dummy signal is further applied to the dummy gate line 26. At this point, the gate signal applied to the gate line 21 includes a high period and a low period, and the low period is much longer than the high period. Therefore, the dummy signal applied to the dummy gate line 26 conventionally has a negative voltage corresponding to the low period of the gate signal without regard to the high period thereof.

Moreover, the dummy gate signal is conventionally different from the gate signal in that the gate signal has a pulse of a high period, for example, but the dummy gate signal only has a low period. Because of the above-mentioned difference, the storage capacitor 25 connected to the dummy gate line 26 has a different charging characteristic from the others. Thus, liquid crystal molecules disposed over the first gate line "$G_1$" have a different aligning characteristic from those of the other molecules disposed over the other gate lines. This difference in the first gate line causes a non-uniform brightness at the first line of the display.

SUMMARY OF THE INVENTION

Accordingly, the present invention is directed to an LCD device that substantially obviates one or more of the problems due to limitations and disadvantages of the related art.

An object of the present invention is to provide a driving method for an LCD device and a driver thereof for preventing non-uniform brightness in the display area.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

In order to achieve these and other advantages, and in accordance with the purpose of the present invention, as embodied and broadly described, a method for driving an LCD device, which adopts a previous gate type circuit, includes a gate line; a data line crossing the gate line; a dummy gate line adjacent the gate line; a thin film transistor connected to the gate and data lines; a first capacitor receiving signals from the thin film transistor; and a storage capacitor connected to the first capacitor. The method includes applying a dummy gate signal to the dummy gate line, wherein the dummy gate signal has substantially the same waveform as a gate signal applied to the gate line.

The gate signal is preferably a pulse signal having a high period of one horizontal line period (1H), and the dummy gate signal is preferably a pulse signal having a high period of one horizontal line period (1H). The high period of the dummy gate signal preferably precedes the high period of the gate signal by one horizontal line period (1H).

In another aspect, the present invention provides a driving circuit of a liquid crystal display device, which adopts a previous gate type circuit including a gate line; a data line crossing the gate line; a dummy gate line adjacent the gate line; a thin film transistor connected to the gate and data lines; a first capacitor receiving signals from the thin film transistor; and a storage capacitor connected to the first capacitor. The driving circuit includes: a gate driver producing a gate signal such that the gate signal is applied to the gate line; a data driver producing a data signal such that the data signal is applied to the data line; and a dummy gate driver producing a dummy gate signal of substantially the same waveform as the gate signal and applying the dummy gate signal to the dummy gate line.

It is to be understood that both the foregoing general description and the following detailed description are exemplary and explanatory and are intended to provide further explanation of the invention as claimed.

BRIEF DESCRIPTION OF THE DRAWING

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

In the first preferred embodiment of the present invention, a pulse signal is used as a dummy gate signal such that all the storage capacitors have the same charging characteristic. Therefore, a non-uniform brightness at the upper portion of the display area as in the conventional previous gate type LCD device is prevented.

Figure 1:
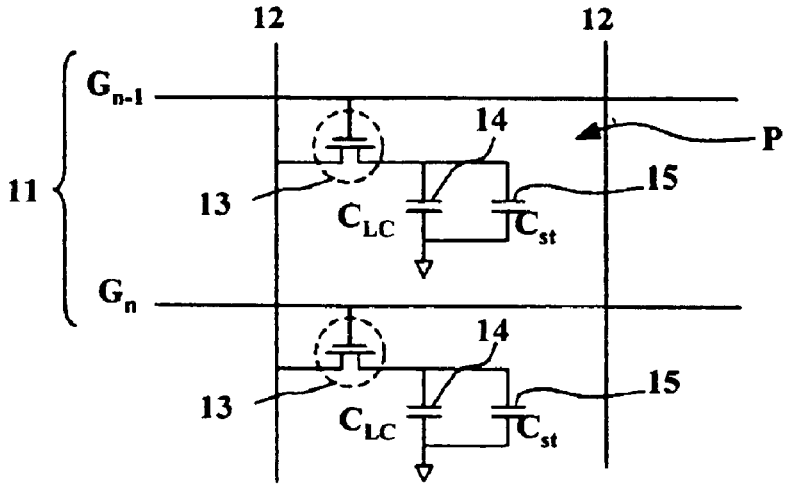
(related art) FIG. 1
FIG. 1 is a circuit diagram illustrating an equivalent circuit for a related art independent storage capacitor type LCD device.
Figure 2:
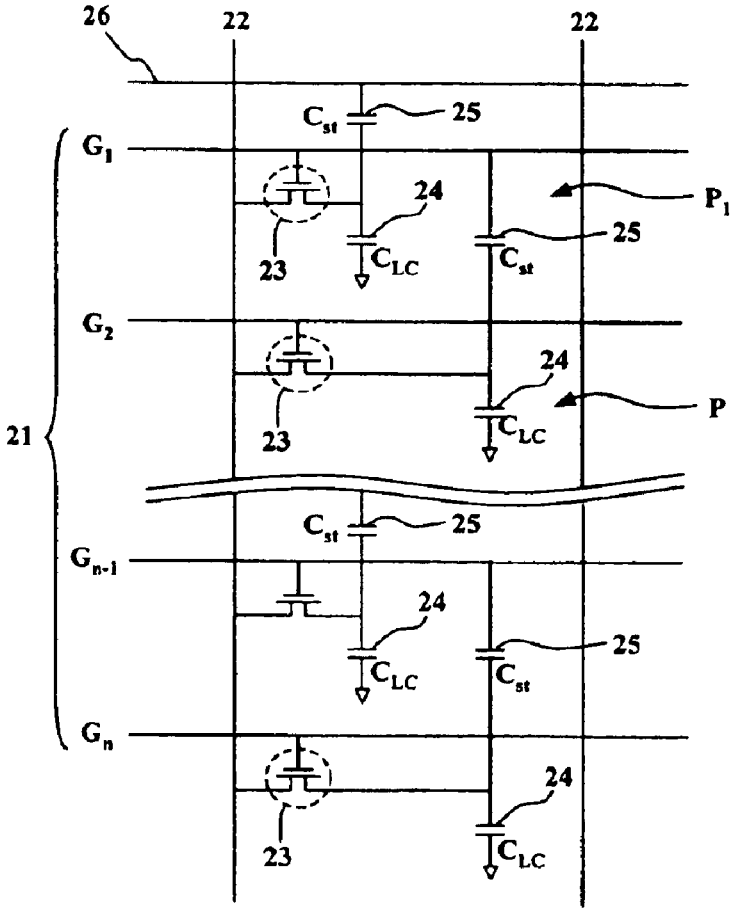
(related art) FIG. 2
FIG. 2 is a circuit diagram illustrating an equivalent circuit for a previous gate type LCD device according the related art.
Figure 3:
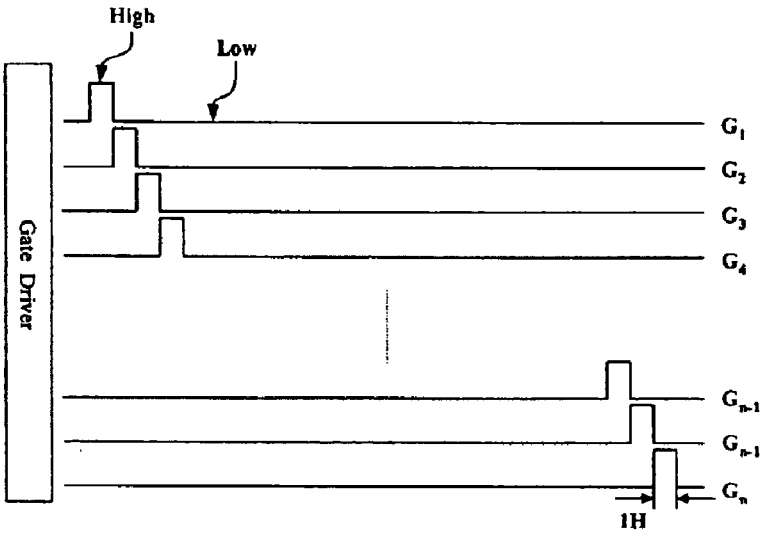
(related art) FIG. 3
FIG. 3 illustrates gate signals applied respectively to the first to nth gate lines of a typical previous gate line type LCD device.
Figure 4:
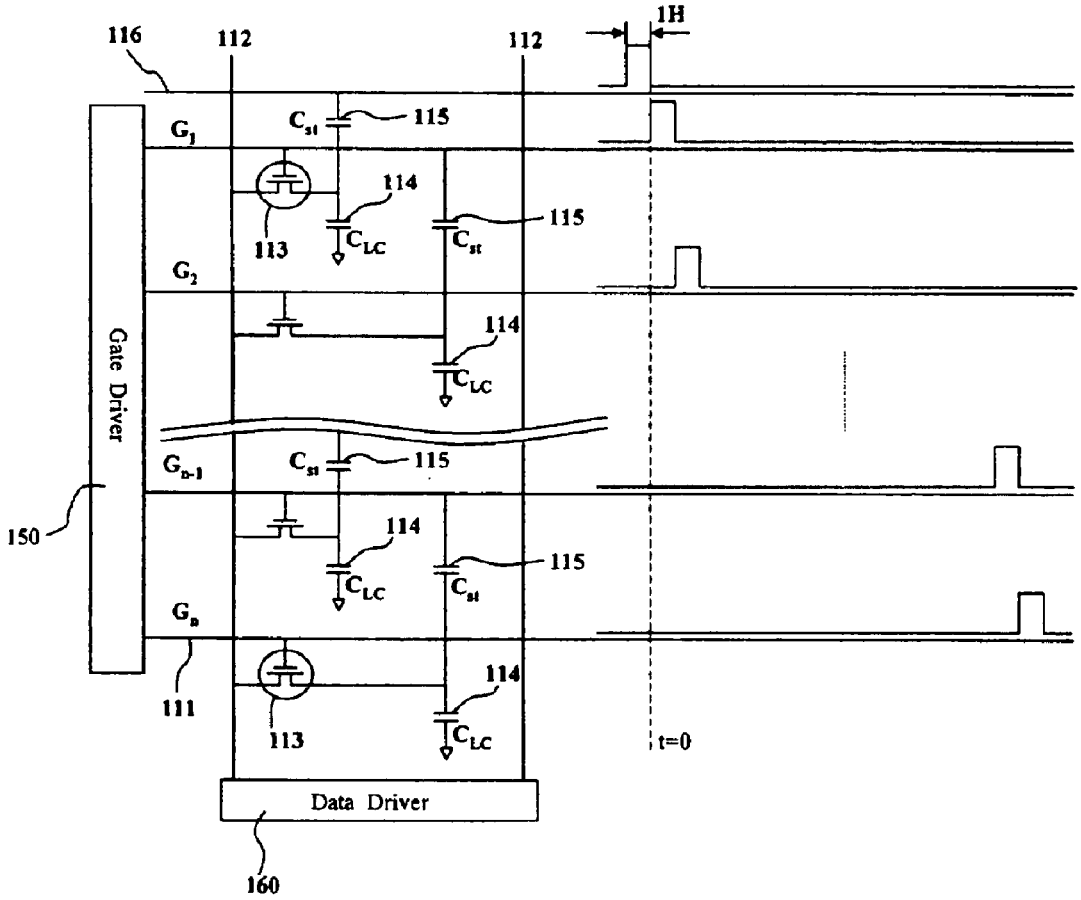
FIG. 4 is a circuit diagram illustrating an equivalent circuit for a previous gate type LCD device according the first preferred embodiment of the present invention.

FIG. 4 illustrates an equivalent circuit for a previous gate type LCD device according to the first preferred embodiment of the present invention. As shown, a plurality of gate and data lines 111 and 112 are perpendicularly disposed crossing each other. Near a crossing point of the gate and data lines 111 (for example, a second gate line "$G_2$") and 112, a TFT 113 is disposed as a switching element. A liquid crystal capacitor 114 is electrically connected to TFT 113, and a storage capacitor 115 is disposed between the liquid crystal capacitor 114 and a previous gate line 111 (for example, a first gate line "$G_1$"). In addition, a dummy gate line 116 is disposed adjacent to the first gate line "$G_1$". A portion of the dummy gate line 116 serves as an electrode of the storage capacitor 115.

Still referring to FIG. 4, a gate driver 150 and a data driver 160 are respectively connected to the gate lines 111 and the data lines 112. The gate driver 150 produces gate signals and applies them to the gate lines 111, whereas the data driver 160 produces data signals and applies them to the data lines 112.

For the above-mentioned configuration, first to nth gate signals are respectively applied to the gate lines 111 including the first to nth gate lines "$G_1$" to "$G_n$". The gate signal is a pulse signal having a high period "1H". The high period of a previous gate signal, the (n−1)th gate signal, precedes that of a current gate signal (the nth gate signal) by "1H" in its timing. In other words, there is a difference of "1H" between the (n−1)th gate signal and the nth gate signal.

In addition, a dummy gate signal is applied to the dummy gate line 116, and the dummy gate signal is preferably a pulse signal having a high period. The high period of the dummy gate signal is also preferably "1H" similar to that of the non-dummy gate signal. In addition, the high period of the dummy gate signal preferably precedes that of the first gate signal by "1H". That is to say, if the high period of the first gate signal starts at a time of t=0, the high period of the dummy gate signal preferably starts at time t=1H. Then, the storage capacitor 115 connected to the dummy gate line 116 has the same charging characteristic as the others connected to the first to nth gate lines 111. As previously mentioned, the non-uniform brightness at the upper portion of the display area can be avoided by the above-mentioned method according to the first preferred embodiment.

Figure 5:
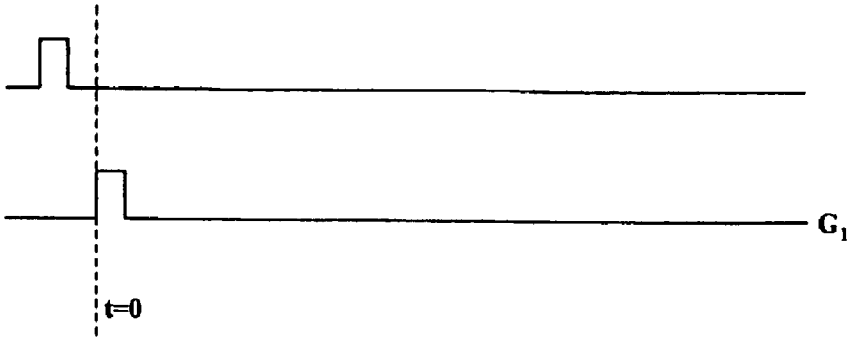
FIG. 5 illustrates a dummy gate signal and gate signals applied to the LCD device according to the first preferred embodiment.

Various methods can be adopted for applying the pulse signal to the dummy gate line 116. For example, an additional controller may be used for producing the pulse signal for the dummy gate line, or a last gate signal applied to a last gate line may be fed back and reused for the dummy gate signal. In the latter method, however, there exists a timing interval between the high periods of the dummy gate signal and first gate signal, as shown in FIG. 5.

Figure 6:
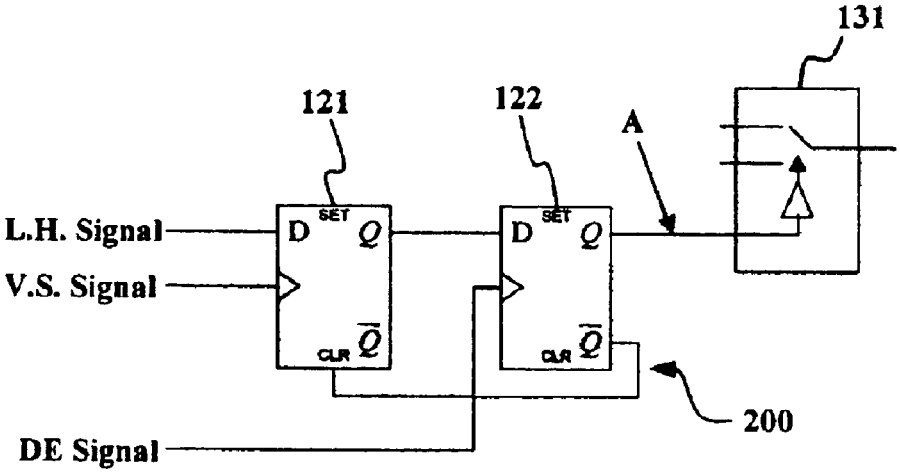
FIG. 6 is a diagram illustrating a dummy signal driver according to the second preferred embodiment of the present invention.
Figure 7:
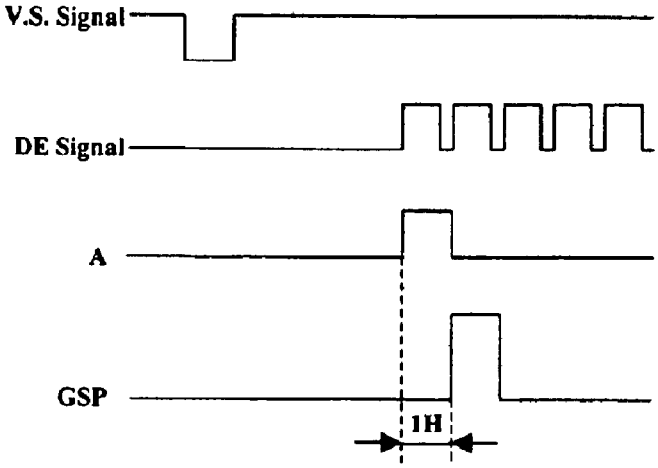
FIG. 7 illustrates various signals produced by the dummy signal driver according to the second preferred embodiment.

Referring now to FIGS. 6 and 7, a control circuit and method are shown for producing the desired dummy gate signal.

FIG. 6 shows a dummy gate signal producing circuit 200 according to a second preferred embodiment. The circuit 200 includes first and second flip-flops 121 and 122, and one level shifter 131. The circuit 200 receives a vertical synchronizing signal (V.S. signal) and a data enable signal (DE signal) and produces the dummy gate signal, which has a high period "1H" preceding the high period of the first gate signal. Specifically, the DE signal is input to a clock of the second flip-flop 122. Then, the DE signal is output from an output terminal "$\overline{Q}$" of the second flip-flop 122, and is subsequently input to a clear "CLR" terminal of the first flip-flop 121. At this point, a logic high signal (L.H. signal) having a positive voltage level and the vertical synchronizing signal (V.S. signal) are further input to an input terminal "D" and a clock of the first flip-flop 121, respectively. Then, the DE signal is transmitted from the first flip-flop 121 to the second flip-flop 122, and a transient pulse signal "A" is subsequently output from the second flip-flop 122. As shown in FIG. 7, a high period of the transient pulse signal "A" precedes a gate starting pulse (GSP) of the first gate signal by "1H". After the transient pulse signal "A" passes through the lever shifter 131, the high period of the transient pulse signal "A" has a similar voltage level as the high period of the gate signals.

Figure 8:
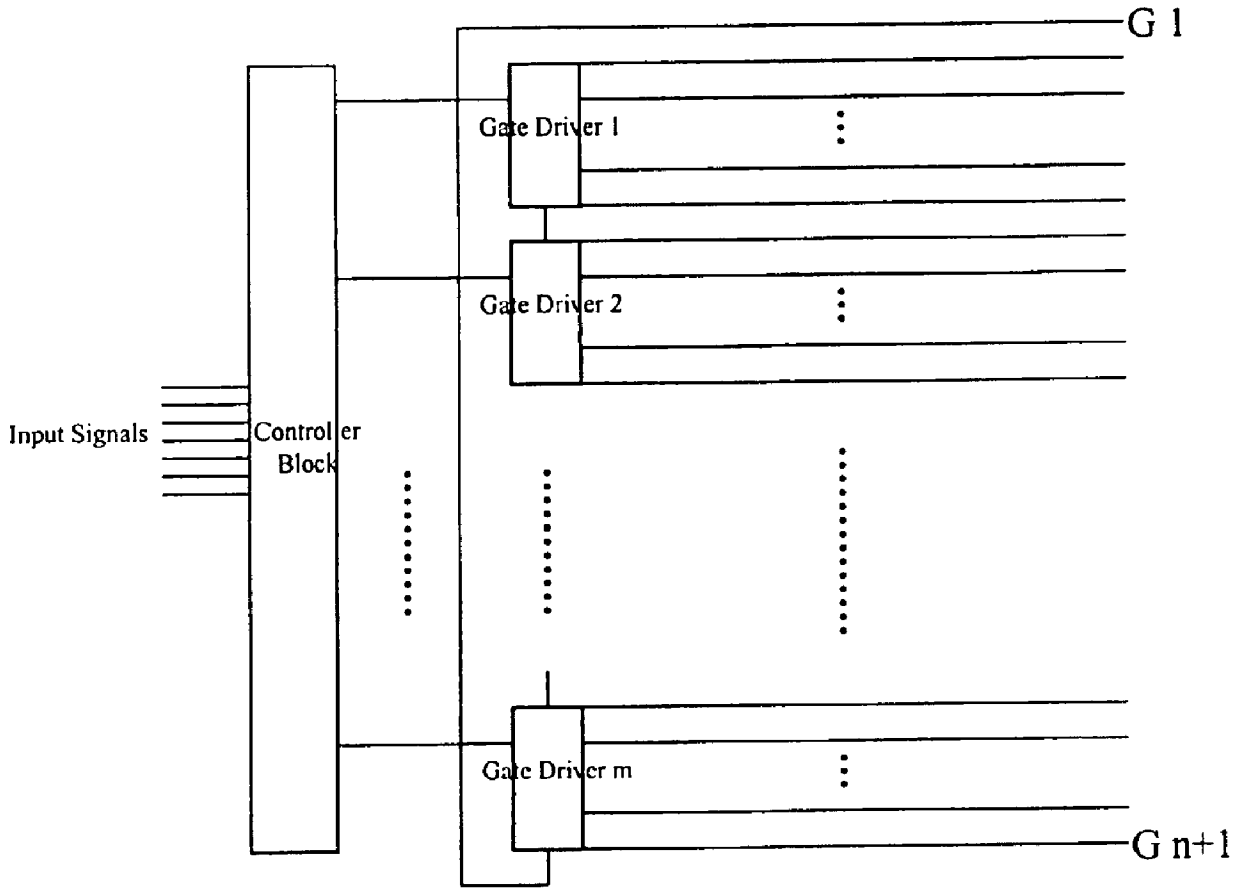
FIG. 8 illustrates an alternative embodiment of the present invention.
Figure 10:
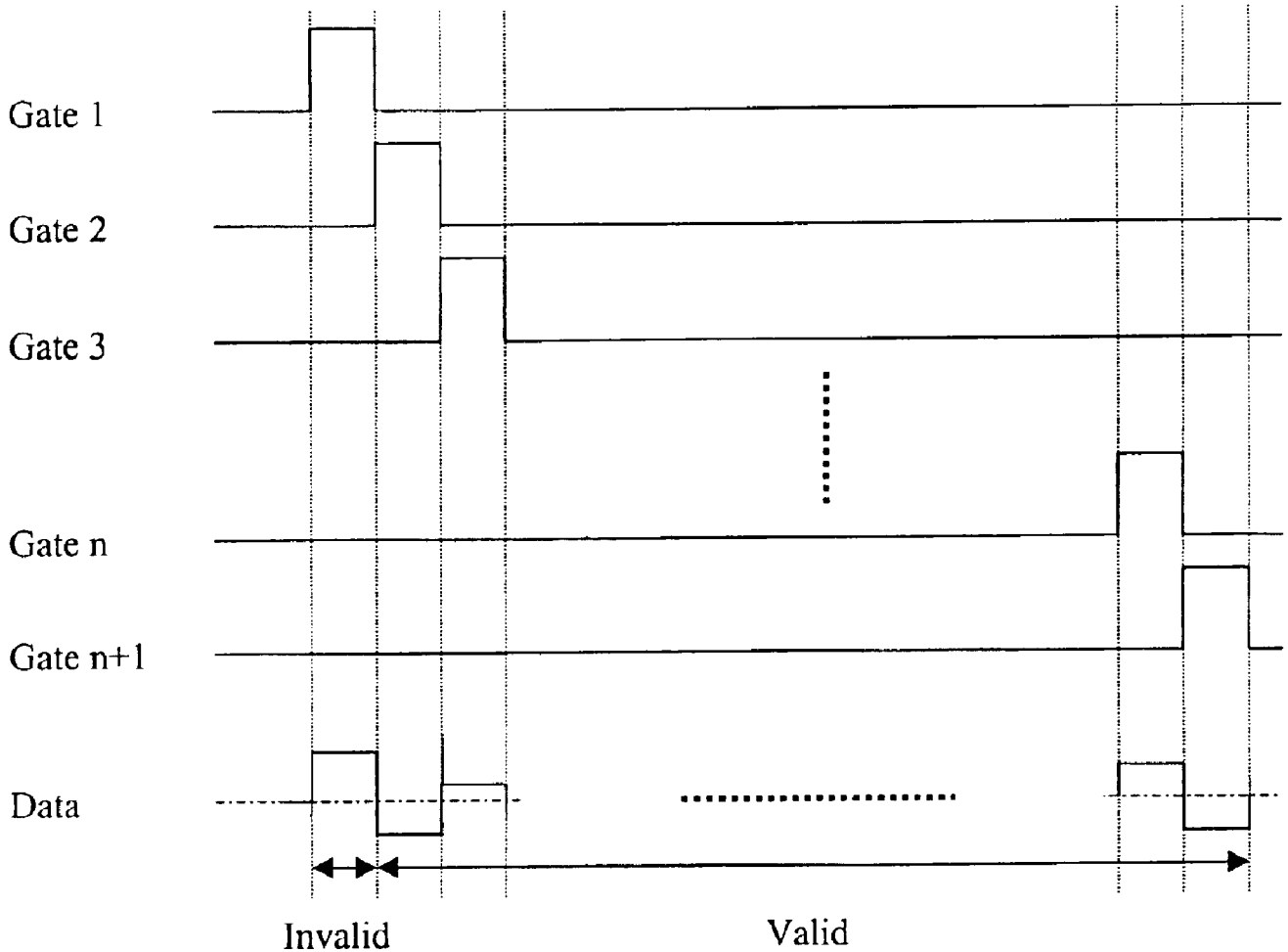
FIG. 10 shows a timing diagram of the gate signals and the data signals in accordance with the alternative embodiments of FIGS. 8 and 9.

FIG. 8 shows an alternative embodiment of the present invention. Here, the last gate signal line (Gn+1) of the gate drivers, which are usually in cascaded fashion as shown, is fed back as the first gate signal line G1. The first gate signal line G1 is a dummy signal line for which the corresponding data signal will not be used. For example, when the first gate line G1 is "ON" the first data signal is invalid and will not be used, as shown in FIG. 10. Beginning with the second gate signal, the remaining data signals are valid. Thus, if 480 vertical lines are used in a display, there will be a total of 481 lines in this embodiment, the first of which would be a dummy line.

Figure 9:
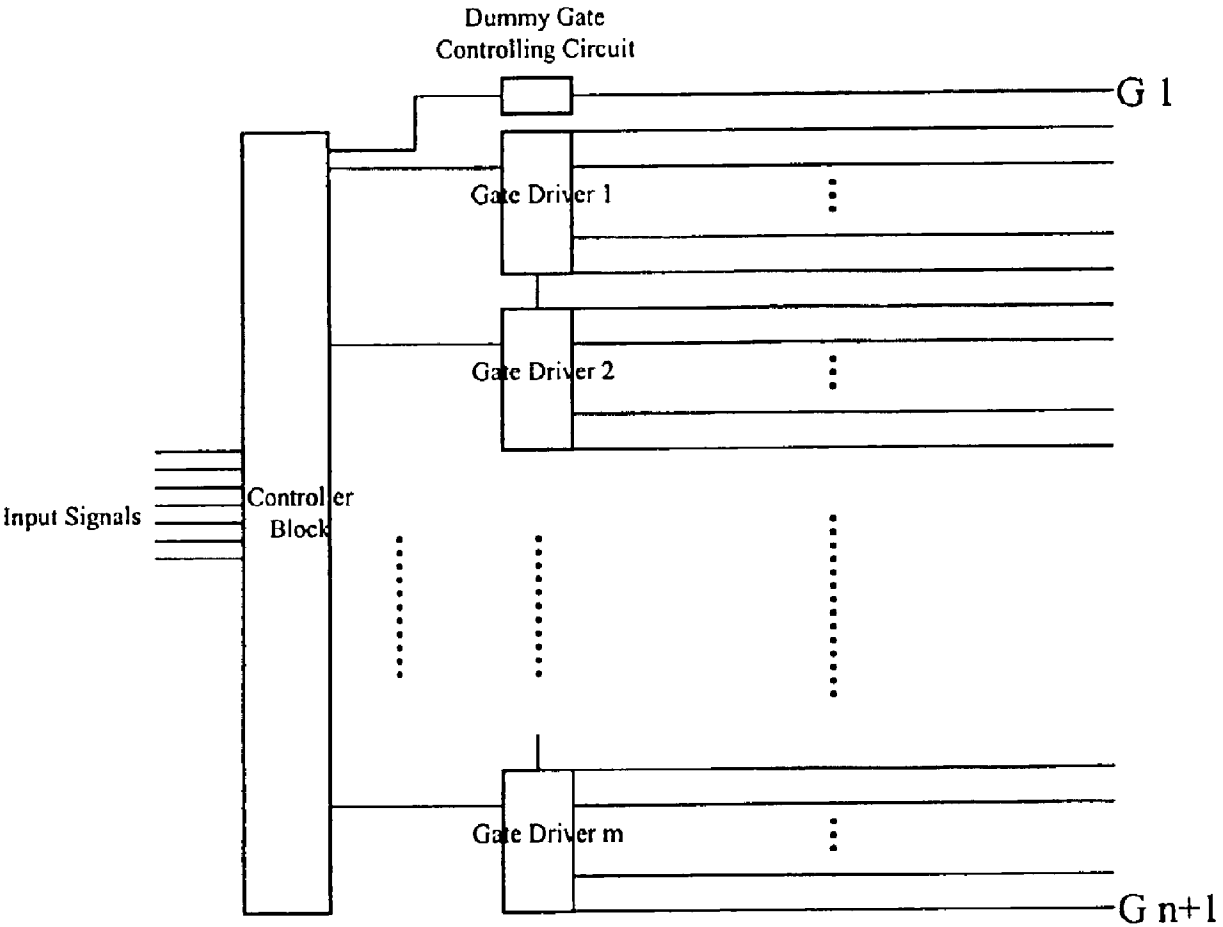
FIG. 9 illustrates another alternative embodiment of the present invention.

Alternatively, rather than feeding back the last gate signal, a separate dummy gate control circuit may be used as the first gate signal G1, as shown in FIG. 9. Of course, there are other variations including using the non-last gate signal to feed back and use as the dummy gate signal. Moreover, a level shifter may be needed depending on whether the input or output signal of the gate driver is used as the feed back signal.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A method of driving a liquid crystal display device, wherein the liquid crystal display device includes a gate line; a data line crossing the gate line; a dummy gate line adjacent the gate line; a thin film transistor connected to the gate and data lines; a first capacitor receiving signals from the thin film transistor; and a storage capacitor connected between the first capacitor and a previous gate line, wherein a portion of the dummy gate line is an electrode of the storage capacitor, the method comprising:

applying a gate signal to the gate line; and applying a logic high dummy gate signal to the dummy gate line, wherein the dummy gate signal has a substantially same waveform as the gate signal applied to the gate line, wherein the dummy gate signal is produced by a dummy gate signal producing circuit including first and second flip-flops and a level shifter.

2. The method of claim 1, wherein the gate signal is a pulse signal having a high period of one horizontal line period.

3. The method of claim 1, wherein the dummy gate signal is a pulse signal having a high period of one horizontal line period.

4. The method of claim 3, wherein the high period of the dummy gate signal precedes the high period of the gate signal by one horizontal line period.

5. A driving circuit of a liquid display device, wherein the liquid crystal display device includes a gate line; a data line crossing the gate line; a dummy gate line adjacent the gate line; a thin film transistor connected to the gate and data lines; a first capacitor receiving signals from the thin film transistor; and a storage capacitor connected to the first capacitor, the driving circuit comprising:

a gate driver producing a gate signal, the gate signal being applied to the gate line;

a data driver producing a data signal, the data signal being applied to the data line; and a dummy gate driver producing a dummy gate signal of a substantially same waveform as the gate signal, the dummy gate signal being applied to the dummy gate line, wherein the dummy gate driver includes first and second flip-flops and a level shifter.

6. The driving circuit of claim 5, wherein a vertical synchronizing signal and a data enable signal are input to the dummy gate driver.

7. A method of driving a liquid crystal display comprising generating a plurality of data signals corresponding to a plurality of gate signals;

applying the generated data signals to one of a plurality of data lines; and applying the gate signals to one of a plurality of gate lines, wherein one of the gate signals is input to a dummy gate line, and the corresponding data signal from the dummy sate line is invalidated, wherein the gate signal input to the dummy gate line is generated by a dummy signal producing circuit that includes first and second flip-flops and a level shifter.

8. A method of driving a liquid crystal display, comprising:

generating a plurality of data signals corresponding to a plurality of gate signals;

applying the generated data signals to one of a plurality of data lines; and applying the gate signals to one of a plurality of gate lines, wherein one of the gate signals is generated by a dummy signal producing circuit that includes first and second flip-flops and a level shifter, and said generated gate signal is applied to a first gate line.

* * * * *